US005405094A

United States Patent [19]

Poser et al.

[11] Patent Number: 5,405,094

[45] Date of Patent: Apr. 11, 1995

[54] MULTI-STAGED SIZE REDUCTION MACHINE

[76] Inventors: Kimberly Poser, 122 Edgehill Dr., Kitchener, Ontario, Canada, N2G 3W6; Engelbert Hones, R.R. #1, Gorrie, Ontario, Canada, N0G 1X0

[21] Appl. No.: 188,977

[22] Filed: Jan. 31, 1994

[51] Int. Cl.[6] ..... B02C 23/16

[52] U.S. Cl. ..... 241/74; 241/89.1; 241/160; 241/162; 241/286

[58] Field of Search ..... 241/74, 86, 89.1, 160, 241/162, 163, 199.7, 199.12, 285.1, 286

[56] References Cited

U.S. PATENT DOCUMENTS

| | | | |
|---|---|---|---|
| 293,047 | 2/1884 | Mackey | 241/162 X |
| 779,031 | 1/1905 | Drake | 241/162 X |
| 1,515,113 | 11/1924 | Holmquist et al. | 241/89.1 X |
| 1,759,100 | 5/1930 | Daniels . | |
| 2,501,622 | 3/1950 | Smith . | |
| 2,639,747 | 5/1953 | Burn et al. | 241/162 X |
| 2,679,788 | 6/1954 | Skardal | 241/160 X |
| 2,716,002 | 8/1955 | Craig . | |
| 2,798,698 | 7/1957 | Dooley | 241/162 X |
| 2,822,846 | 2/1958 | Ward . | |
| 3,249,310 | 5/1966 | Williams . | |
| 4,605,173 | 8/1986 | Edmonds . | |
| 5,096,128 | 3/1992 | Chang | 241/160 X |
| 5,282,579 | 2/1994 | Poser et al. | 241/74 X |

*Primary Examiner*—Timothy V. Eley
*Attorney, Agent, or Firm*—Jeffrey T. Imai; Arne I. Fors; D. Doak Horne

[57] ABSTRACT

A size reduction machine for use in process industries to continuously and precisely reduce the size of particles, while controlling fines, has a rotatable spindle and a motor operably connected to the spindle for effecting rotation of the spindle. The spindle is mounted within a channel having an input and an output. The size reduction machine comprises a first stage impeller mounted on the spindle, a first screen rigidly mounted within the channel so that particles passing from the input to the output pass through the first screen as the first stage impeller rotates relative to the first screen, a second stage impeller mounted on the spindle, a second screen rigidly mounted within the channel so that particles passing from the first screen will pass through the second screen as the second stage impeller rotates relative to the second screen, a spacer for positioning the impellers along the spindle to maintain a first gap between an edge of the first stage impeller and an interior of the first screen and to maintain a second gap between an edge of the second stage impeller and an interior of the second screen.

13 Claims, 4 Drawing Sheets

MULTI-STAGED SIZE REDUCTION MACHINE

FIELD OF INVENTION

This invention relates to a size reduction machine and in particular a size reduction machine having a multi-staged impeller for reducing the size of particulate material.

BACKGROUND OF THE INVENTION

Size reduction machines of the prior art utilize a frusto-conical shaped screen located in a channel between an input and an output. Such size reduction machines are more particularly described in U.S. Pat. No. 4,759,507. In these machines, various screens and impellers are used depending on the size and type of product that is being processed. The screens have apertures in different sizes and shapes to produce a desired milled product.

Once the desired impeller and screen have been selected and the gap therebetween properly adjusted, particulate material is passed through the machine and the size of the material is reduced. The amount or reduction is dependent on a number of factors, including the size of the apertures of the screen, the angle of the wall of the screen, the gap between the wall of the screen and the impeller. In many cases, the desired particle size cannot be achieved with a single pass. The particulate must first be passed through a machine having a first screen and then passed through a machine having a second screen. In some extreme cases, the particulate must be passed a third or fourth time. If the production facility does not have enough machines, the same machine must be dismantled and a second screen must be installed and calibrated. This process is very time consuming, requiring skilled technicians to properly adjust the gap between the impeller and screen. Further, problems of quality control increases as the number of times the machines are dismantled increases. These problems become particularly acute when the machines are used preparing pharmaceuticals.

There have been a number of machines which have attempted to address this problem by increasing the number of stages on the impeller. Such machines are described in U.S. Pat. Nos. 2,822,846 and 3,249,310. These machines are capable of reducing particulate material into a smaller particulate size but are in essence two size reduction machines stacked one on top of the other and mounted on a common shaft. These machines are unable to fit within the size restrictions demanded in the pharmaceutical industry. Further, these machines are unable to meet the strict quality requirements of the pharmaceutical industry.

SUMMARY OF THE INVENTION

The disadvantages of the prior art may be overcome by providing a size reduction machine having a multi-staged impeller and a plurality of screens for reducing the size of a particulate material in a single pass.

It is desirable to provide a device having an impeller having a first and second set of blades for rotating past a first screen and a second screen, respectively for multi-staged reduction of particulate size with a single pass.

According to one aspect of the invention, there is provided a size reduction machine for use in process industries to continuously and precisely reduce the size of particles, while controlling fines. The machine has a rotatable spindle and a motor operably connected to the spindle for effecting rotation of the spindle. The spindle is mounted within a channel having an input and an output. The size reduction machine comprises a first stage impeller mounted on the spindle, a first screen rigidly mounted within the channel so that particles passing from the input to the output pass through the first screen as the first stage impeller rotates relative to the first screen, a second stage impeller mounted on the spindle, a second screen rigidly mounted within the channel so that particles passing from the first screen will pass through the second screen as the second stage impeller rotates relative to the second screen, a spacer for positioning the impellers along the spindle to maintain a first gap between an edge of the first stage impeller and an interior of the first screen and to maintain a second gap between an edge of the second stage impeller and an interior of the second screen.

DETAILED DESCRIPTION OF THE DRAWINGS

In figures which illustrate embodiments of the invention,

DETAILED DESCRIPTION OF THE INVENTION

Figure 1:
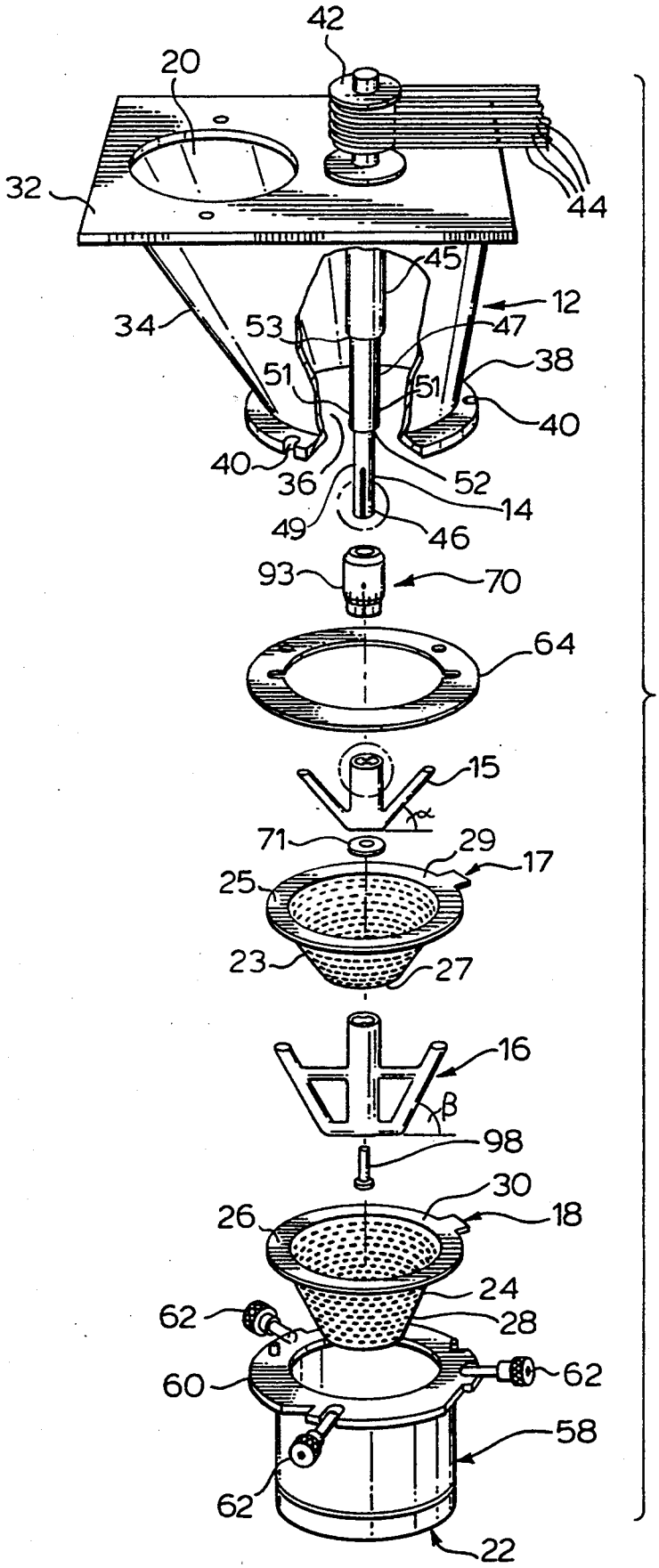
FIG. 1 is an exploded perspective view of the size reduction machine incorporating the invention.
Figure 2:
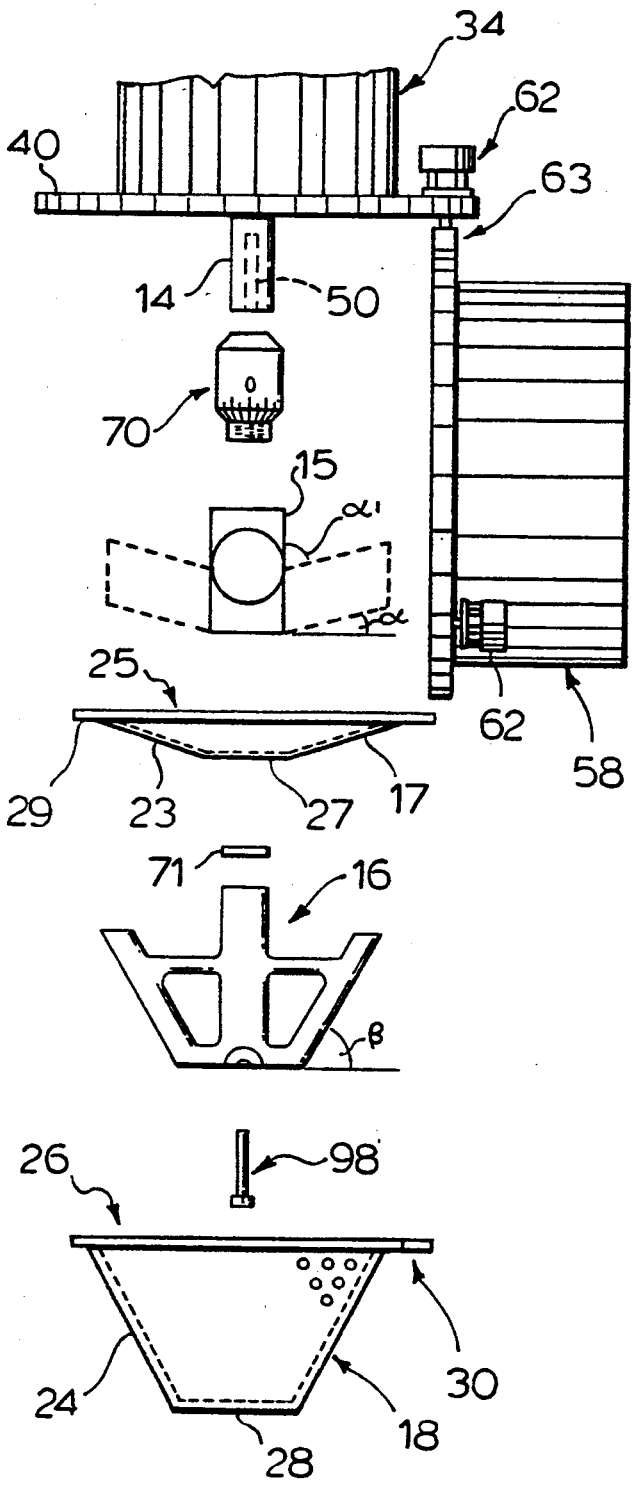
FIG. 2 is an exploded elevational view of the size reduction machine of FIG. 1.

The size reduction machine incorporating the present invention is illustrated in FIG. 1. The machine generally has a housing 12, a spindle 14, a first stage impeller 15, a second stage impeller 16, a first stage screen 17 and a second stage screen 18. The spindle 14 and impellers 15 and 16 are located in a channel having an input 20 and an output 22.

Screen 17 has a tapered apertured wall 23 formed into a frusto-conical shape with a wide end 25 and a narrow end 27. Both ends 25 and 27 are open. Opening 27 is sized to sealingly receive the axial body portion of impeller 16. The screen 17 has a circular flange 29 which surrounds and extends outwardly of the wide end 25.

Similarly, screen 18 has a tapered apertured wall 24 formed into a frusto-conical shape with a wide end 26 and a narrow end 28. End 26 is open while end 28 is at least partially closed. The screen 18 has a circular flange 30 which surrounds and extends outwardly of the wide end 26.

The bank angle $\alpha$ between an imaginary line perpendicular to the axis of rotation of spindle 14 and the working surface of the blade of the impeller 15 and also the angle of the tapered wall 23 is less than the corresponding bank angle $\beta$ of impeller 16 and tapered wall 24. In addition, the size of the apertures of tapered wall 23 is generally greater than the size of the aperture of tapered wall 24 of screen 18.

Flanges 29 and 30 have the same approximate diameter to allow screen 17 to nest within screen 18 when installed in the channel.

Housing 12 has a top cover plate 32 having input 20 offset to one side of the housing 12. Immediately below the top cover plate 32 is a wall 34 defining the channel for passing particles to be milled. Wall 34 converges to a circular opening 36. The circumference of circular opening 36 has an outwardly extending flange 38 having a plurality of circumferentially spaced notches 40.

Shroud 58 has a circular flange 60 surrounding the opening at the upper end. Flange 60 has a plurality of bolts 62 attached to hinges 63 for pivotal attachment thereto. The bolts 62 are circumferentially spaced about the flange 60 to mate with notches 40 of flange 38 of housing 12. Gasket 64 is adapted to seal the joint between flanges 38 and 60.

Spindle 14 is rotatable mounted on top cover plate 32 using conventional bearings and mounts. The spindle 14 extends longitudinally through housing 12 defining an axial extent. The axis of rotation of spindle 14 is concentric with the center of the circular opening 36. Spindle 14 extends upwardly from the top cover plate 32 to present a shaft for receiving pulleys 42 adapted to be driven by belts 44 from a suitable drive (not illustrated).

Spindle 14 is stepped presenting a plurality of circumferential surfaces 45, 47 and 49. The diameter of surface 49 is less than the diameter of surface 47 which is less than the diameter of surface 45. Circumferential surfaces 45, 47 and 49 establish shoulders 52 and 53. Surface 47 has a pair of diametrically opposed machined flat surfaces 51 for receiving complementary fittings of impeller 15.

Figure 3:
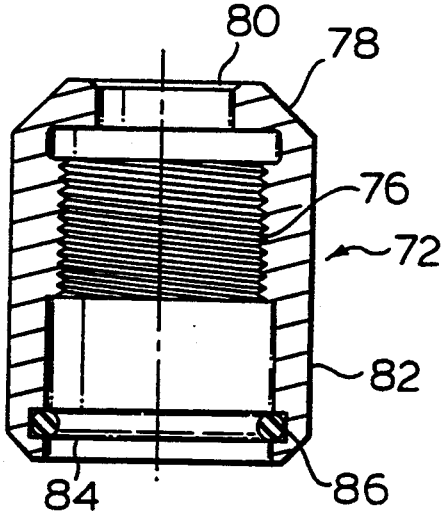
FIG. 3 is a sectional view of one of the collars of the spacing device of the size reduction machine of FIG. 1.
Figure 4:
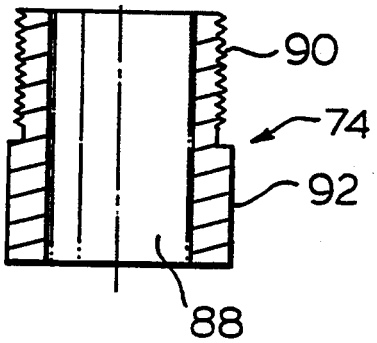
FIG. 4 is a sectional view of the other of the collars of the spacing device of the size reduction machine of FIG. 1.

The extensible spacer device 70 illustrated in FIGS. 3 and 4 comprises of a collar 72 and collar 74. Collar 72 has a central bore having an internal thread 76. The diameter of the central bore is greater than the outside diameter of the circumferential surface 47 of the spindle 14. The upper end of collar 72 has an end seal portion 78 presenting an opening 80. Opening 80 has a diameter within very close tolerances with the outside diameter of circumferential surface 47 of spindle 14. Collar 72 has a shroud 82 which extends axially defining an internal bore. The inner face of the lower end of shroud 82 has a ring groove 84 adapted to receive an O-ring 86.

Collar 74 has a central bore 88 extending axially. The central bore 88 has a diameter within very close tolerances with the outside diameter of the circumferential surface 47 of spindle 14. Collar 74 has an external thread 90 cut on a barrel portion. Thread 90 is adapted for threaded engagement with internal thread 76 of collar 72. Collar 74 has a base portion 92 having an external diameter. The external diameter of base 92 is within close tolerances with the inside diameter of the internal bore of shroud 82. As is apparent, collar 74 will fit within collar 72 with O-ring 86 sealing the threaded portion from penetration by or intrusion of particles during operation.

The base of collar 74 has a calibrated scale 93 on an external face. The scale 93 is relative to the type and coarseness of the thread 90. Rotation of collar 72 relative to collar 74 will advance or detract collar 74, varying the axial length of spacer device 70. A standard micrometer relationship between the rotation of the collar and the extension distance of spacer 70 is used.

Alternatively, other spacing devices such as washers or spacers could used. The use of spacers or washers is well known in the art.

Figure 5:
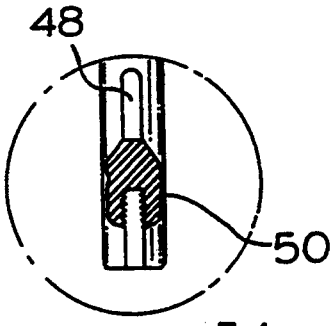
FIG. 5 is an elevational view of the receiving end of the shaft, partially in section, of the size reduction machine of FIG. 1.

Referring to FIG. 5, the receiving end 46 of spindle 14 has diametrically opposed machined flat surfaces 48 for receiving complementary fittings of impeller 16. Machined surfaces 48 are rotated 90° relative to machined surfaces 51. The remote end of receiving end 46 has an axially extending threaded bore 50.

Figure 6:
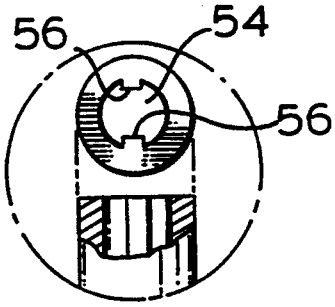
FIG. 6 is an elevation view, partially in section, and top plan view of the mating end of the impeller of the size reduction machine of FIG. 1.
Figure 7:
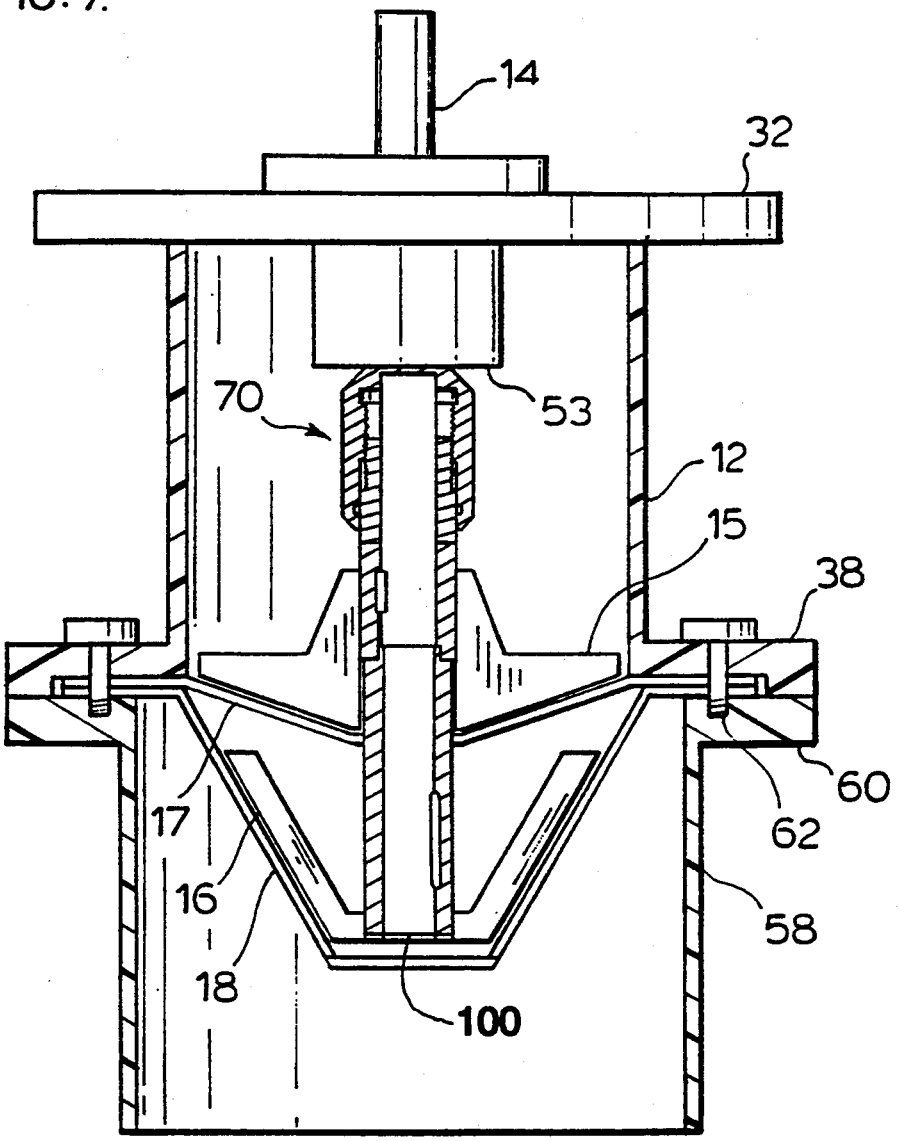
FIG. 7 is an elevational view of the size reduction machine of FIG. 1 in an assembled condition.

Referring to FIG. 6, impellers 15 and 16 have an axially extending central aperture 54. Central aperture 54 axially extends through the axial body portion of impellers 15 and 16. Central aperture 54 has complementary abutments 56 for mating with flat machined surfaces 48 and 51, respectively, of spindle 14. Although machined surfaces 48 and 51 and abutments 56 have been described, any type of engagement surfaces, such as keyways, splines, etc., may be used provided rotational drive can be effectively transmitted from the spindle 14 to the impellers 15 and 16. FIG. 7 illustrates a key and keyway arrangement.

To assemble the size reduction machine, spacer 70 is preset to a known axial length setting to establish a predetermined gap between impeller 16 and screen 18. Spacer 70 is presented to spindle 14, followed by impeller 15. Gasket 64 is presented to flange 38. Screen 17 is presented to gasket 64. Washer 71 is presented to the base of impeller 15. Washer 71 has a predetermined thickness for spacing impeller 16 along spindle 14 for establishing the gap between impeller 16 and screen 18. Impeller 16 is presented to spindle 14 through opening 27 of screen 17. Bolt 98 is presented to counter bore 100 of impeller 16 to engage threaded bore 50 of spindle 14. Bolt 98 is tightened, urging impeller 16 against spacer 70 against shoulder 53. End seal portion 78 forms a metal to metal seal with shoulder 52 of spindle 14 substantially preventing particles from entering the interior of spacer 70. Spacer 70 is releasably fastened, fixing the gap between the impeller 16 and screen 18.

Since machined surfaces 48 and 51 on spindle 14 are 90° relative to each other, impellers 15 and 16 are also 90° relative to each other. The offsetting of impellers 15 and 16 enhance the flow of particulate material through the screens 17 and 18. As particulate material passes through screen 17, the material will flow onto screen 18 before the impeller blade of impeller 16 urges the particulate material through screen 18.

The corresponding screen 18 is selected and placed in shroud 58. Shroud 58 is presented to screen 17. Bolts 62 are pivoted and introduced into notches 40 to releasably attach the shroud 58 to the housing.

The bank angle $\alpha$, the aperture size of screen 17 and corresponding impeller are selected depending on the type and input size of the material being milled and the amount of reduction desired. The bank angle $\beta$, aperture size of screen 18 and the corresponding impeller are selected according to the desired output size and consistency. The selection of bank angle, aperture size, gap size and impeller type is well known in the operation of size reduction machines.

In use, product to be milled is introduced into input 20. The product falls through housing 12, past the rotating first stage impeller 15, through screen 17, past the rotating second stage impeller 16, through screen 18 and downwardly through shroud 58 to exit through output 22.

To change the gap setting, the shroud 58 and screen 18 are removed exposing the impeller 16. Bolt 98 is removed allowing screen 17 and first stage impeller 15 to be removed. The axial length of the spacer 70 is set by rotating collar 72 relative to collar 74. The size reduction machine is reassembled ready for use.

While the invention herein has been described in connection with exemplary embodiments, it will be understood that many modifications will be apparent to those skilled in the art.

We claim:

1. A size reduction machine for use in process industries to continuously and precisely reduce the size of particles, while controlling fines, said size reduction machine comprising a rotatable spindle, a motor operably connected to said spindle for effecting rotation of said spindle, said spindle being mounted within a channel having an input and an output, a first stage impeller mounted on said spindle, a first screen rigidly mounted within said channel so that particles passing from the input to the output pass through said first screen as said first stage impeller rotates relative to the first screen, a second stage impeller mounted on said spindle, a second screen rigidly mounted within the channel so that particles passing from the first screen will pass through the second screen as the second stage impeller rotates relative to the second screen, a spacer means for positioning the impellers along said spindle to maintain a first gap between an edge of said first stage impeller and an interior of said first screen and to maintain a second gap between an edge of said second stage impeller and an interior of said second screen, wherein said first screen is nested within said second screen.

2. A size reduction machine as claimed in claim 1 wherein said first screen and said second screen have a common mount.

3. A size reduction machine as claimed in claim 1 wherein said first screen is nested within said second screen.

4. A size reduction machine as claimed in claim 1 wherein said first screen has a first bank angle and said second screen has a second bank angle, said first bank angle is less than the second bank angle.

5. A size reduction machine as claimed in claim 4 wherein said first screen has an open narrow end adapted to sealingly engage a tubular body portion of said second impeller.

6. A size reduction machine as claimed in claim 5 wherein blades of said second impeller are sized to freely rotate between the first screen and said second screen.

7. A size reduction machine as claimed in claim 1 wherein said spacer means comprises a first spacer device for establishing a gap between the first impeller and the first screen and a second spacer device for establishing a gap between the second impeller and the second screen.

8. A size reduction machine as claimed in claim 7 wherein one of said first spacer device and said second spacer device is a washer having a predetermined thickness and the other is an extensible spacer device.

9. A size reduction machine as claimed in claim 8 wherein said extensible spacer device comprises a first collar having an axially extending bore and an internal thread on an inside surface of said bore, said first collar having a circumferential shroud extending axially, a second collar having a base portion, a barrel portion and an axially bore extending therethrough, said barrel portion having an external thread adapted to threadingly engage said internal thread, said shroud adapted to cover said barrel portion and frictionally engage said base portion when said first collar threadingly engages said second collar, a calibrated scale on said base portion and a plurality of gradations circumferentially extending about said shroud to indicate an axial length of said spacer device as said first collar is rotated relative to said second collar.

10. A size reduction machine as claimed in claim 1 wherein said first impeller has a pair of opposed blades and said second impeller has a pair of opposed blades and said first and second impellers are mounted on said spindle whereby the blades of said first impeller are 90° relative to the blades of the second impeller.

11. A size reduction machine as claimed in claim 10 wherein said spacer means comprises a first spacer device for establishing a gap between the first impeller and the first screen and a second spacer device for establishing a gap between the second impeller and the second screen.

12. A size reduction machine as claimed in claim 11 wherein one of said first spacer device and said second spacer device is a washer having a predetermined thickness and the other is an extensible spacer device.

13. A size reduction machine as claimed in claim 12 wherein said extensible spacer device comprises a first collar having an axially extending bore and an internal thread on an inside surface of said bore, said first collar having a circumferential shroud extending axially, a second collar having a base portion, a barrel portion and an axially bore extending therethrough, said barrel portion having an external thread adapted to threadingly engage said internal thread, said shroud adapted to cover said barrel portion and frictionally engage said base portion when said first collar threadingly engages said second collar, a calibrated scale on said base portion and a plurality of gradations circumferentially extending about said shroud to indicate an axial length of said spacer device as said first collar is rotated relative to said second collar.

* * * * *